US010777903B2

(12) United States Patent
Basnev et al.

(10) Patent No.: US 10,777,903 B2
(45) Date of Patent: Sep. 15, 2020

(54) MULTI-BEAM ANTENNA (VARIANTS)

(71) Applicants: Evgenij Petrovich Basnev, Korolev (RU); Anatolij Vasilevich Vovk, Korolev (RU)

(72) Inventors: Evgenij Petrovich Basnev, Korolev (RU); Anatolij Vasilevich Vovk, Korolev (RU)

( * ) Notice: Subject to any disclaimer, the term of this patent is extended or adjusted under 35 U.S.C. 154(b) by 0 days.

(21) Appl. No.: 16/335,010

(22) PCT Filed: Aug. 7, 2017

(86) PCT No.: PCT/RU2017/050071
§ 371 (c)(1),
(2) Date: Mar. 20, 2019

(87) PCT Pub. No.: WO2018/063037
PCT Pub. Date: Apr. 5, 2018

(65) Prior Publication Data

US 2019/0252790 A1 Aug. 15, 2019

(30) Foreign Application Priority Data

Oct. 1, 2016 (RU) ..... 2016138756

(51) Int. Cl.
*H01Q 15/16* (2006.01)
*H01Q 25/00* (2006.01)
(Continued)

(52) U.S. Cl.
CPC ..... *H01Q 15/16* (2013.01); *H01Q 5/45* (2015.01); *H01Q 19/17* (2013.01); *H01Q 25/007* (2013.01)

(58) Field of Classification Search
CPC ..... H01Q 15/16; H01Q 5/45; H01Q 19/00; H01Q 19/17; H01Q 25/00; H01Q 25/007
See application file for complete search history.

(56) References Cited

U.S. PATENT DOCUMENTS 3,984,840 A 10/1976 Dell-Imagine
4,203,105 A 5/1980 Dragone et al.
(Continued)

FOREIGN PATENT DOCUMENTS

EP 2221919 A1 8/2010
JP 5014193 A 9/2009
(Continued)

OTHER PUBLICATIONS

International Search Report dated Nov. 17, 2017 for corresponding International Application No. PCT/RU2017/050071, filed Aug. 7, 2017.

(Continued)

*Primary Examiner* — Hoang V Nguyen
(74) *Attorney, Agent, or Firm* — David D. Brush; Westman, Champlin & Koehler, P.A.

(57) ABSTRACT

A multi-beam antenna includes: a focusing system having a concave mirror; a radiating device, which is intended for irradiating the concave mirror, includes a two-dimensional radiator array, is disposed at a distance from the concave mirror and covers the projection area of beams at this distance; and a beam forming system. The radiating device includes at least one sub-array of radiators which provides one beam in a set direction. For each such beam, the beam forming system provides, for each radiator in the corresponding sub-array, amplitude-time parameters of the signal being transmitted such as to form a non-planar wavefront, which is equidistant across the concave mirror to a planar wavefront of the beam, wherein the radiating surface of the radiator array is situated outside the region of self-intersection of the non-planar wavefronts.

8 Claims, 7 Drawing Sheets

(51) Int. Cl.
*H01Q 5/45* (2015.01)
*H01Q 19/17* (2006.01)

(56) References Cited

U.S. PATENT DOCUMENTS

| | | | | |
|---|---|---|---|---|
| 4,965,587 | A | 10/1990 | Lenormand et al. | |
| 5,280,297 | A | 1/1994 | Profera, Jr. | |
| 5,576,721 | A * | 11/1996 | Hwang | H01Q 25/007 343/753 |
| 5,959,578 | A | 9/1999 | Kreutel, Jr. | |
| 6,147,656 | A | 11/2000 | Luh | |
| 7,889,129 | B2 | 2/2011 | Fox et al. | |
| 2006/0267851 | A1 * | 11/2006 | Turner | H01Q 1/288 343/781 CA |
| 2015/0061930 | A1 | 3/2015 | Runyon | |

FOREIGN PATENT DOCUMENTS

| | | | |
|---|---|---|---|
| JP | 2009200704 | A | 9/2009 |
| RU | 2084059 | C1 | 7/1997 |
| RU | 2626023 | C2 | 7/2017 |
| RU | 2015157178 | A | 7/2017 |

OTHER PUBLICATIONS

Written Opinion of the International Searching Authority dated Nov. 23, 2017 for corresponding International Application No. PCT/RU2017/050071, filed Aug. 7, 2017.

International Search Report dated Nov. 17, 2017 for corresponding International Application No. PCT/RU2017/050078, filed Aug. 21, 2017.

Written Opinion of the International Searching Authority dated Nov. 23, 2017 for corresponding International Application No. PCT/RU2017/050078, filed Aug. 21, 2017.

English translation of the International Search Report dated Nov. 17, 2017 for corresponding International Application No. PCT/RU2017/050071, filed Aug. 7, 2017.

English translation of the Written Opinion of the International Searching Authority dated Nov. 23, 2017 for ccorresponding International Application No. PCT/RU2017/050071, filed Aug. 7, 2017.

English translation of the International Search Report dated Nov. 17, 2017 for corresponding International Application No. PCT/RU2017/050078, filed Aug. 21, 2017.

English translation of the Written Opinion of the International Searching Authority dated Nov. 23, 2017 for corresponding International Application No. PCT/RU2017/050078, filed Aug. 21, 2017.

* cited by examiner

MULTI-BEAM ANTENNA (VARIANTS)

CROSS-REFERENCE TO RELATED APPLICATIONS

This Application is a Section 371 National Stage Application of International Application No. PCT/RU2017/050071, filed Aug. 7, 2017, the content of which is incorporated herein by reference in its entirety, and published as WO 2018/063037 on Apr. 5, 2018, not in English.

FIELD OF THE DISCLOSURE

The invention relates to telecommunication multi-beam antenna systems with a focal device, consisting of a two-dimensional array of feeders, in which many beams are simultaneously generated by setting the amplitude-time parameters of the signals for each feeder.

BACKGROUND OF THE DISCLOSURE

Currently, there is a need for Ka-band multi-beam antennas for geostationary spacecraft, that have a large enough service area, about 12×10 degrees on the Earth's surface, with a beam width of about 0.25 degrees, with a number of subscriber beam positions of 1000-2000, and the gain is not less than 55 dBi.

At the same time, the number of active channels is approximately an order of magnitude smaller than the positions of the beams and subscribers are serviced by quickly switching active channels between positions (beam hopping) with a visit time interval of the active position no more than 125 ms (to enable voice transmission) and a visit time of 1-12 ms (data superframe length).

Such a beam width and gain, at small angles of beam deflection, can be implemented for any traditional scheme of reflector antenna with an aperture of about Ø3 m. But at the same time, due to aberration effects, there is a drop in the gain by 6 . . . 10 dB and an increase in the width of the beams to 0.5 . . . 1.0 degrees at the edges of the service area. In addition, to place the required number of fixed feeders for such a density of positions and size of the service area is almost impossible.

Such a beam width and an any number of beam positions can be realized in Active Electronically-Scanned Array (AESA), but the required gain and minimization of the grating lobes can be ensured by two mutually exclusive ways:

Or almost completely get rid of the grating lobes, which implies weakly directed partial feeders with a lattice spacing of about one wavelength. In this case there will be an insignificant, no more than 1 . . . 3 dB drop at the edges of the service area, but the lattice with an aperture of Ø3 m and a hexagonal grid step equal to the wavelength (transmission, 20 GHz) should have about 36 thousand partial feeders. With the current level of technology is almost impossible.

Or use highly directional partial feeders with a diameter of 6-8 wavelengths. But the grating with such feeders will have a gain drop at the edges of the service area, about 6 . . . 10 dB, and the grating lobes become unacceptably powerful and may even exceed the level of the main beam with large deviations. The use of an aperiodic lattice with highly directional partial feeders, for example, an annular one, somewhat improves the position with the grating lobes, "smearing" them around the annular region and reducing their level by 15 . . . 20 dB. But with extreme deviations of the beam, this annular region can still get to the surface of the Earth, which is highly undesirable. In addition, there is the problem of satellite illumination on the opposite side of the geostationary orbit.

There are various schemes of reflector antennas with an irradiating device (ID) on the basis of a phased array (Phased Array Feed Reflector, PAFR). The advantage of such schemes is that a fairly simple focusing device provides the necessary aperture, and the difficult to implement active phased array has small dimensions. Such a lattice can form multiple focal radiation centers (virtual irradiators) using certain subarrays of partial feeders.

In such an ID, the grating lobes can be almost completely removed, since, due to the much smaller area of the ID, the lattice spacing can be reduced.

They can also be significantly reduced in the far zone of the antenna, since in the zone between the ID and the focusing system, they are not a rotated flat wave front, but a rotated spherical wave front and mostly go beyond the focusing system. In addition, a certain aperiodicity of placement of partial feeders can be made by placing them on the concave spherical surface of an ID, providing approximately the same viewing angle of the focusing system for each partial feeder.

But this scheme does not eliminate the main drawback of systems with a focusing system and a point feeder. All of them have optical aberrations (mostly coma), and can realize a rather small coverage area with given beam parameters.

In the invention [JP 5014193], adopted by the authors for the prototype, an attempt was made to form virtual irradiators, to some extent taking into account the problem of aberrational distortion.

This invention has a focusing system consisting of one or a plurality of reflectors, an ID, consisting of an array of feeders, covering the radiation zone of the focusing system and located closer or further to the focal point of the focusing system, and a beamforming system controlling the amplitude and phase parameters of the feeders in the sub-arrays, corresponding to each ray. This invention involves measuring (or calculating) the amplitude-phase characteristics of the incoming beam for each feeder in a subarray, limited by the projection of the aperture from the incoming beam on the ID surface, and assigning these characteristics to the same feeder to form the outgoing beam.

The disadvantage of this method is that the simple definition and setting of the phase (phase shift) for each partial feeder will lead to the common problems of all phased arrays on phase shifters:

- low positioning accuracy of the rays and a large phase error, since the bit depth of the phase shifters, as a rule, does not exceed 6-8 bits;
- intersymbol interference, which will lead to a significant reduction in the signal bandwidth;
- the dependence of the angle of deflection of the beam from the frequency, which will lead to the "spreading" of the radiation pattern along the spectrum of the modulated carrier frequency—an analogue of chromatic aberration in optics.

However, due to the relatively small size of the lattice, these problems can be eliminated by a beamforming system with true time delays, which is supposed in this invention.

A more serious disadvantage is the lack of criteria for optimizing the geometry of the surfaces of the focusing system and the relative position of the ID and the focusing system. There is also a problem with power amplifiers of feeders for a transmitting ID with sub-arrays of feeders (to be discussed below).

SUMMARY

The objective of this invention is the creation of a class of antennas, completely or partially free from these disadvantages, while maintaining the main advantages:

separation of tasks "formation of beams", "providing the necessary aperture" and "providing power";

providing a large number of active rays.

In the first variant, this problem is solved by the fact that in a multi-beam antenna, containing a focusing system, consisting of a concave mirror, an irradiating device designed to irradiate a concave mirror, consisting of a two-dimensional array of feeders, placed at a distance from the concave mirror and overlapping the area of the beams projections on it distance, and a beam-forming system, while the irradiating device contains at least one subarray of feeders, providing one beam with a plane wave front in a given direction. For each such beam, the beamforming system provides such amplitude-time parameters of the transmitted radio signal for each feeder in its sub-array to form a non-planar wave front, equidistant through the concave mirror to the flat wave front of such a beam, while the radiating surface of the irradiating device is outside the self-intersection zone of non-planar wave fronts.

In the second variant, this problem is solved by the fact that in a multi-beam antenna containing a focusing system, consisting of primary and secondary concave mirrors, an irradiating device designed to irradiate the focusing system, consisting of a two-dimensional array of feeders, placed at a distance from the secondary mirror and overlapping the intersection zone of the projections of the beams at this distance, and the beam-forming system, the irradiating device provides all the beams with plane wave fronts in given directions, and for each of such a beam, the beam-forming system provides such amplitude-time parameters of the transmitted radio signal for each feeder to form a non-planar wave front, equidistant through the focusing system to the plane wave front of such a beam, while the radiating surface of the irradiating device is outside the self-intersection zone of non-planar wave fronts.

In both cases, the reflecting surfaces of the focusing system can be made as surfaces of revolution of the conic section, while the axis of rotation may not coincide with the axes of the conic section. Also, the reflective surfaces of the focusing system can be made as pulling surfaces of the forming curves with a continuous second derivative.

The multi-beam antenna in this invention may be transmitting, receiving, or transmitting-receiving with different variations of the polarization of the radio signal. In this description, two variants of the transmitting antenna are considered. Variants of the receiving antenna are obtained by inverting the transmitting and receiving elements.

Also possible such schemes in which, for example, an ID in a single-mirror antenna is located so that it overlaps the intersection of the projections of the rays and is not divided into sub-arrays, and in an two-mirror antenna, ID is located in such a way that it overlaps the areas of the projections of the rays and divides into subarrays. Such schemes are extremely inefficient, as they require significantly larger mirrors or ID.

BRIEF DESCRIPTION OF THE DRAWINGS

Further, the invention is disclosed in more detail using graphic materials, where.

DETAILED DESCRIPTION OF ILLUSTRATIVE EMBODIMENTS

For simplicity of perception, the following designations are common for the antenna variants shown:

The irradiating device 1, its partial feeders 2 and the radiating surface 3, formed by the phase centers of the feeders 2;

Apertures 4 . . . 7 for the deviation angles $\pm\alpha$ and $\pm\beta$, and their projections 4*a* . . . 7*a* on the ID;

Plane wave front 5*b*, corresponding to aperture 5;

Non-flat wave fronts, equidistant to the front 5*b*:

5*c*—at the exit from the radiating surface 3 (the wave front touches the surface 3 at the point K1);

5*d*—at the entrance to the radiating surface 3 (the wave front touches the surface 3 at the point K2);

5*e*—in the zone of self-intersection of wave fronts;

Feeder 2*n* and distance Tn, which determines its time delay.

Figure 1:
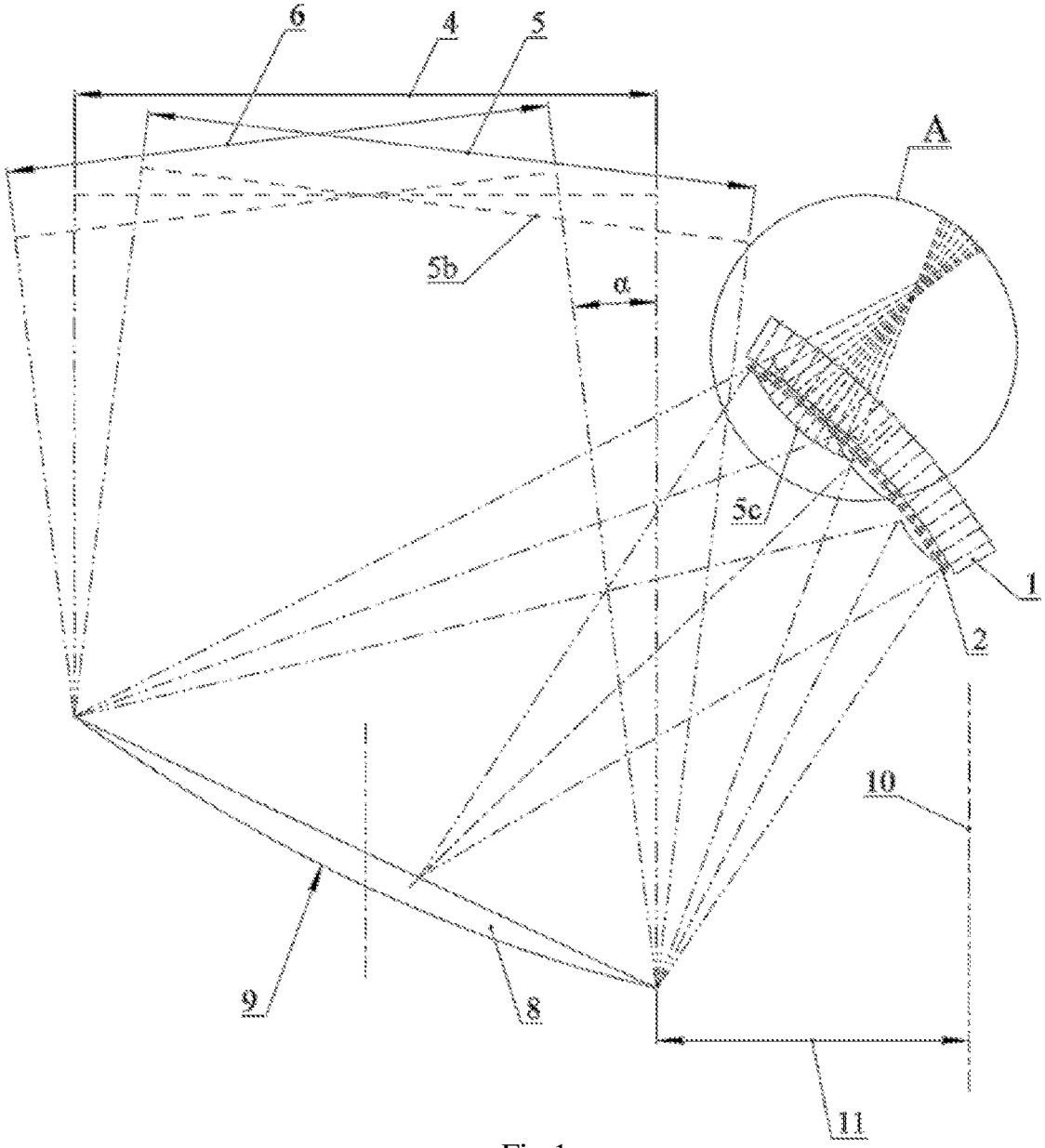
FIG. 1—front view of a single-mirror antenna (Variant 1)
Figure 2:
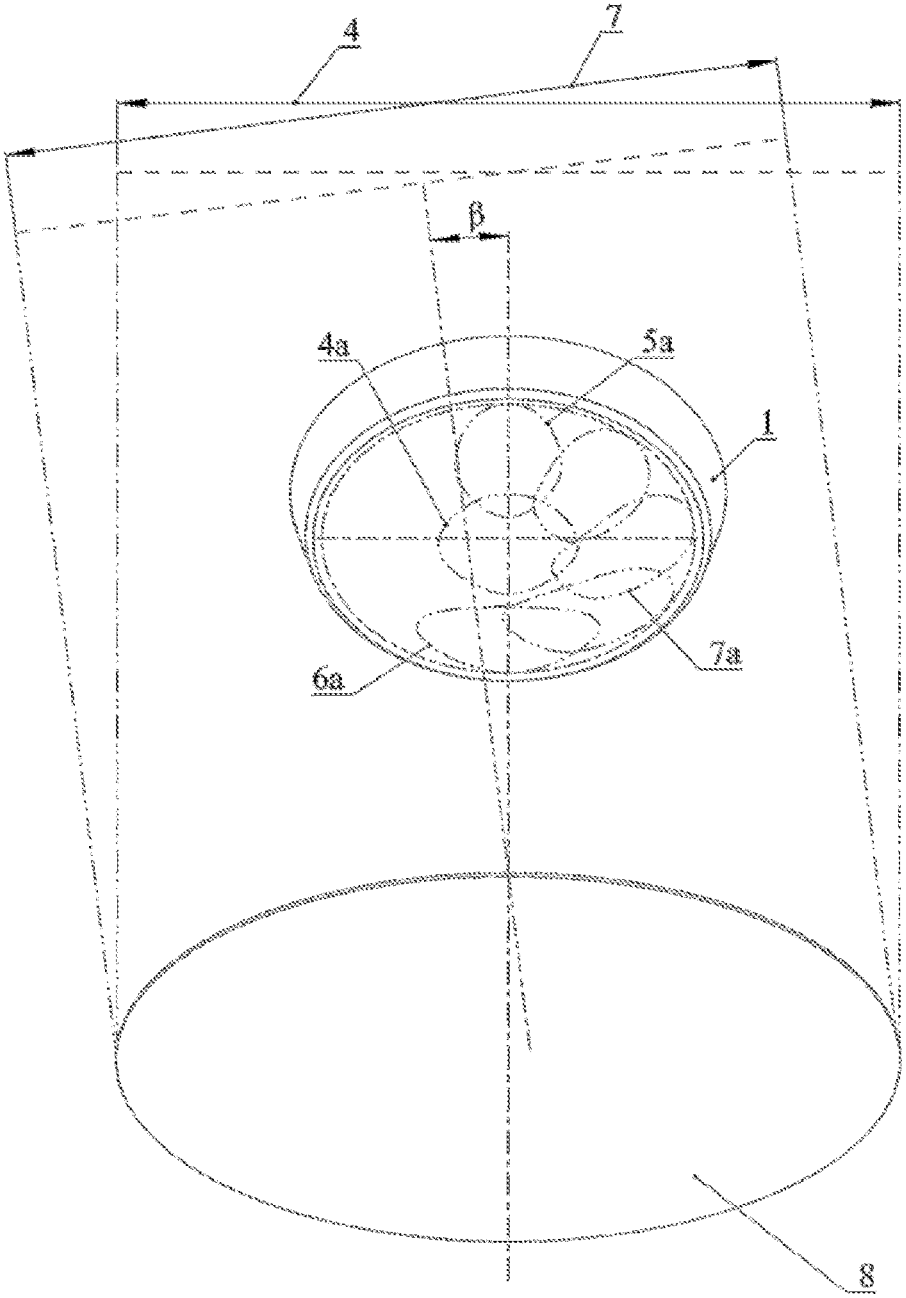
FIG. 2—a left side view of a single-mirror antenna.

FIG. 1, 2, 3 shows a single-mirror antenna consisting of a reflector 8 and an irradiating device 1 with partial feeders 2. The reflector 8 is formed by rotating the forming curve 9 relative to the axis 10. The forming curve 9 can be any conical section, and in this case represents a hyperbole. The axis of rotation 10 does not have to coincide with the axis of the forming curve, and its position, given by size 11, is one of the parameters for optimizing the scheme of the antenna, affecting the position and size of the projections of the rays on the ID in the direction of the angle $\pm\beta$ (the position of the projection 7*a* on FIG. 2).

FIG. 4-8 shows a two-mirror antenna consisting of reflector 12, subreflector 13 and ID 1 with partial feeders 2.

Figure 4:
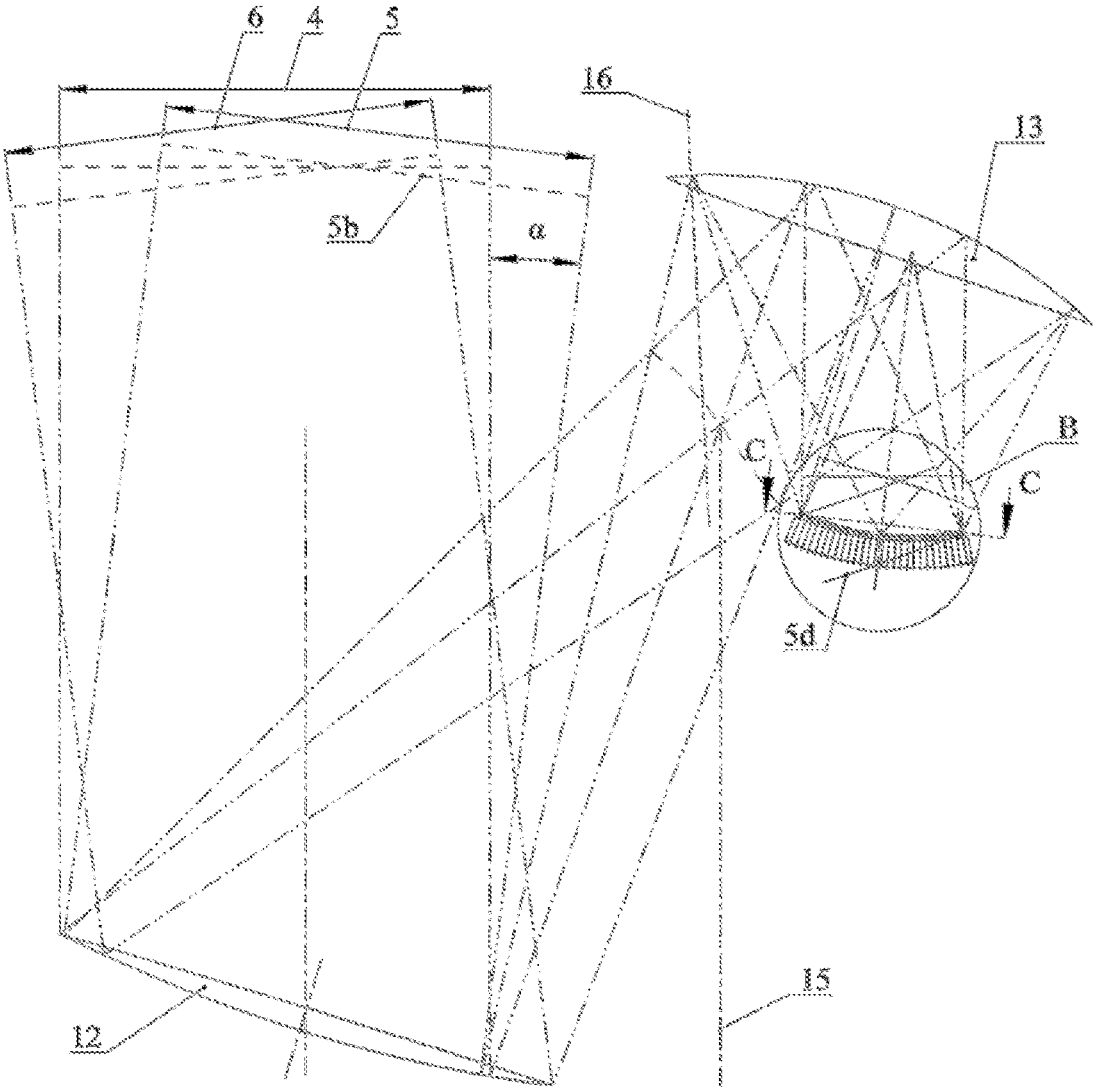
FIG. 4—front view of a two-mirror antenna (Variant 2)

Apertures 4 . . . 6 in FIG. 4 are shown in the "from the ID" trace so that the size of the reflector 12 is determined by the given ID size and the required apertures. Front Se is not shown, since the ID is far beyond the self-intersection of the fronts. In this case, the projections 4*a* . . . 7*a* and 4*f* . . . 7*f* are defined as the projections of the full aperture of the reflector 12 on the subreflector 13 and the ID 1. The partial feeders 2 are placed in zone 14 (FIG. 6, feeders are not shown), which is the intersection of the projections of the reflector 12 from all specified directions.

In this particular scheme, the reflector 12 is designed as a paraboloid of rotation with an axis 15 coinciding with the axis of the parabola, and the subreflector 13 is designed as an elliptical surface with a rotation axis 16 that does not coincide with the axes of the forming ellipse.

Figure 3:
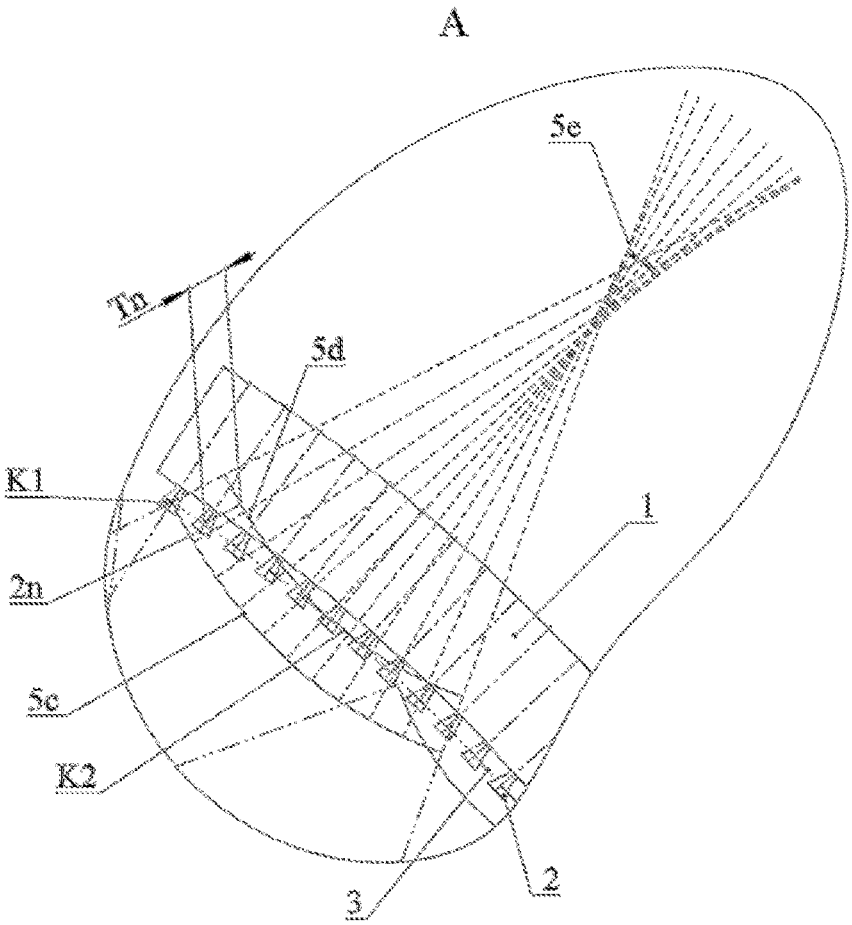
FIG. 3—an enlarged fragment A of an irradiating device of a single-mirror antenna.
Figure 5:
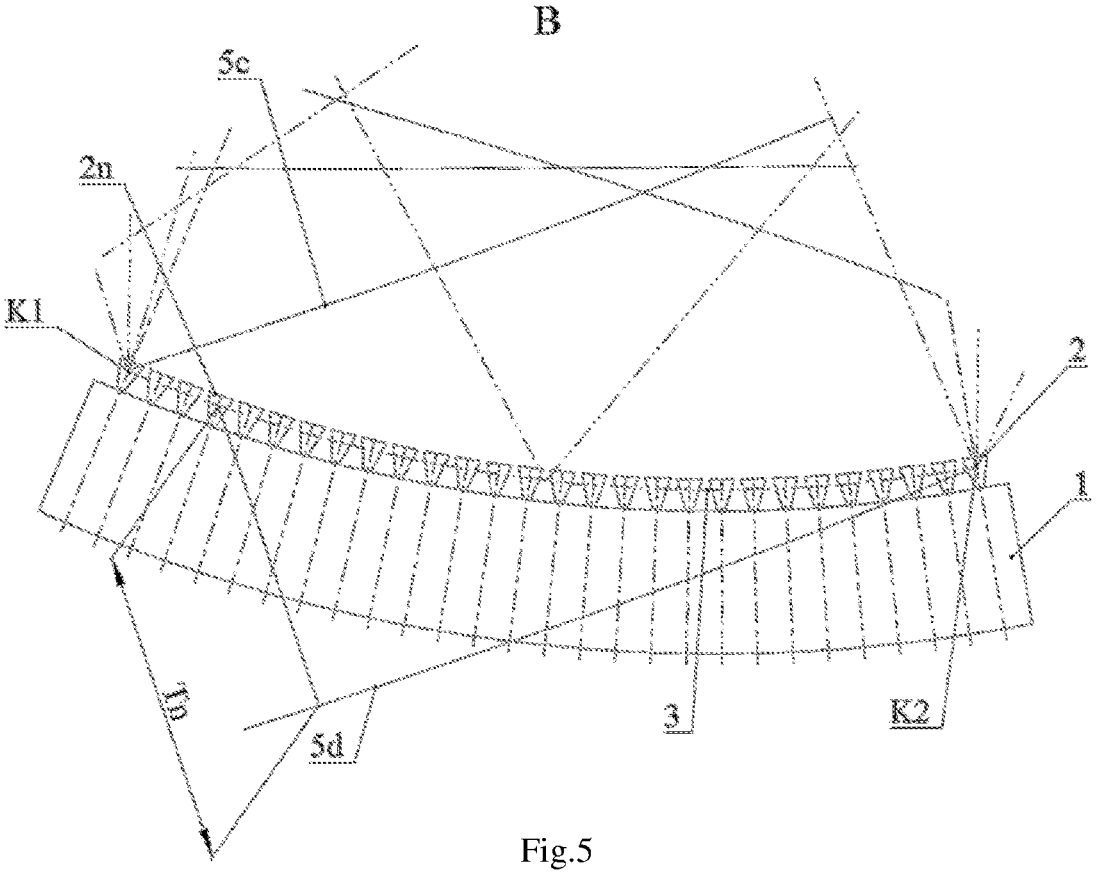
FIG. 5—an enlarged fragment B of the irradiating device of a two-mirror antenna.
Figure 6:
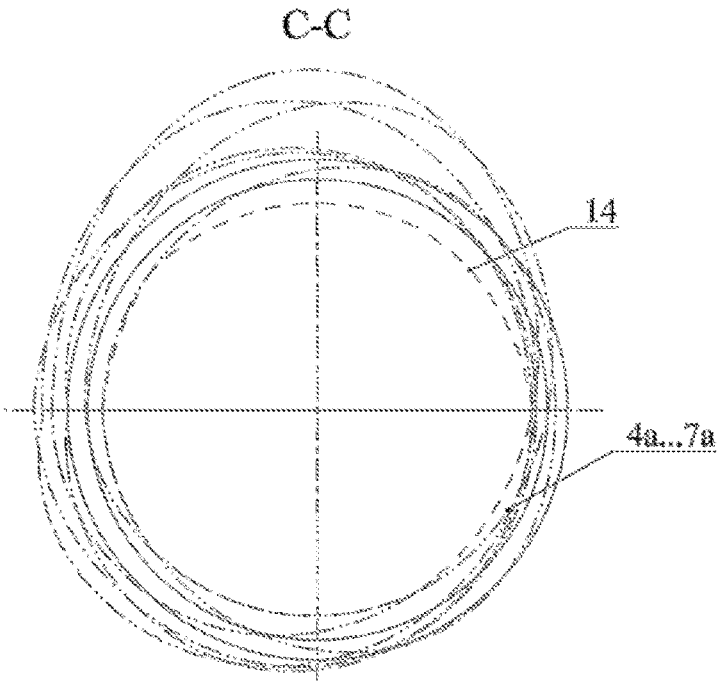
FIG. 6—an enlarged section C-C of the irradiating device of a two-mirror antenna.
Figure 7:
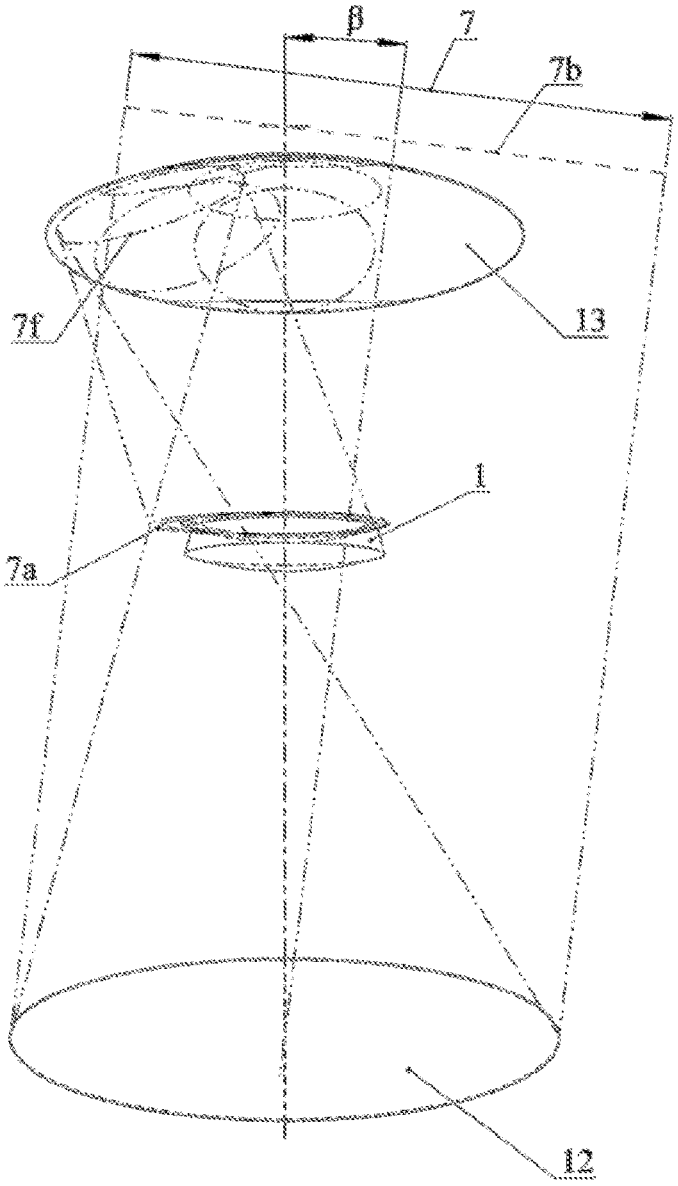
FIG. 7—a left side view of a two-mirror antenna.
Figure 8:
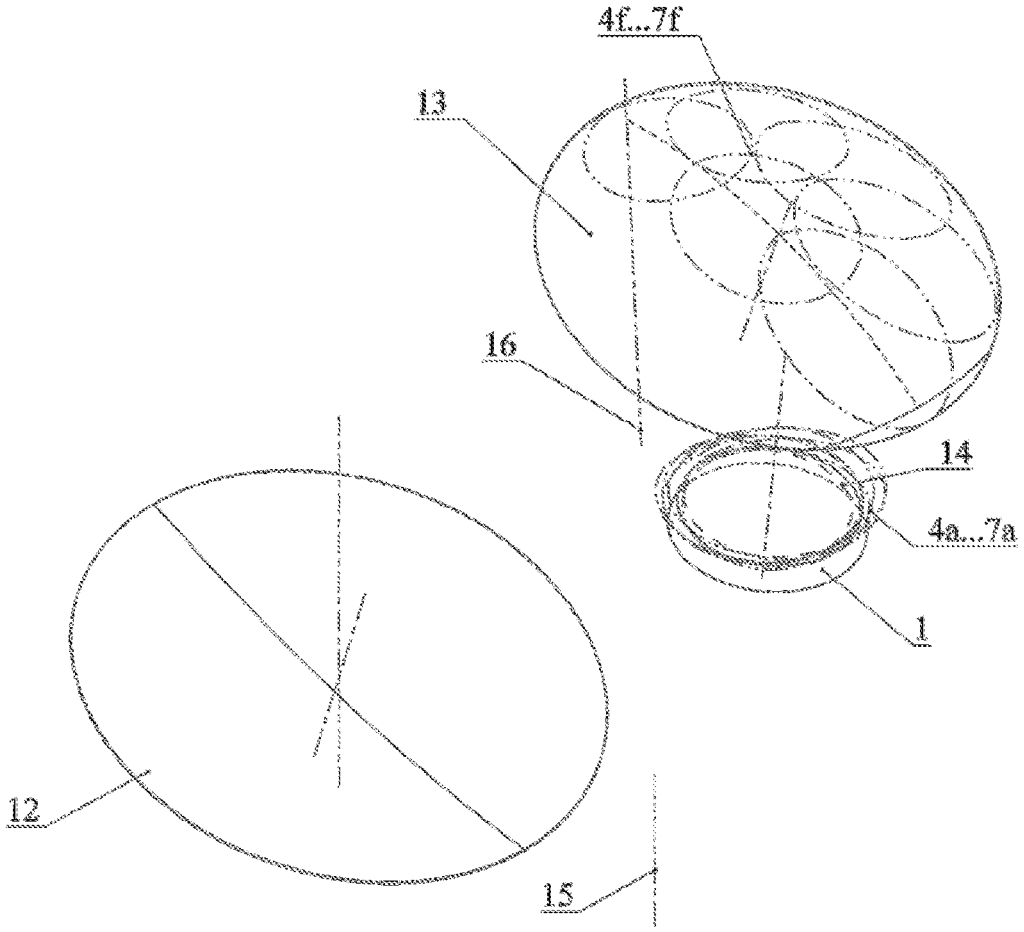
FIG. 8—an isometric view of a two-mirror antenna.

FIG. 3 and FIG. 5 show the principle of the formation of the wave front 5*d*, equidistant to wave front Sb in a given direction of the beam.

The front 5*d* can be constructed, for example, by reverse tracing from an arbitrary (up to a constant) plane 5*b* by the Monte Carlo method. In this case, the distance Tn determines the time delay for the feeder 2*n*, and the number of tracing rays in a certain neighborhood of its phase center, for example, at a distance of $\lambda/2$, determines its amplitude.

Thus, it is possible to determine the amplitude-time parameters for the entire subarray of feeders for a given direction of the beam.

However, the features of solid state power amplifiers (PA) impose some restrictions on the use of variant 1 in transmitting antennas. The fact is that powerful transistors have, as a rule, a normally-open channel. In this case, the energy consumption in the absence of a signal at the input practically does not decrease, and the time of entry into the linear mode is comparable with the time between visits with a jumping beam (beam hopping) of any position. Accordingly, if there is a radiation position with at least one subscriber, all partial feeders in the subarray for this position must be constantly powered. Of course, each partial feeder serves more than a hundred positions in the central zone of the ID and about 3-5 positions on the periphery of the ID (or 10-15 positions, if with minor damage to the directional pattern of peripheral beams, to remove weakly used peripheral feeders).

But the nature of the distribution of active subscribers can be very changeable (ships and aircraft, road and rail transport, sparsely populated areas, etc). Therefore, the power consumption of the antenna will need to rely on the statistically worst case, and, given that the power consumption of the PA is weakly dependent on the number of beams served by it, the overall efficiency of the antenna will fall by 10-20 percent. Local gradients of heat dissipation over the surface of the ID are also possible.

Variant 2 is deprived of this disadvantage, since all partial feeders serve all beam positions, with approximately the same amplitude distribution for each beam. Thus, variant 1 is preferably used as a receiving antenna, and variant 2 as a transmitting or receiving-transmitting one. Of course, these considerations are basically true for a repeater with jumping beams. For an adaptive repeater with rarely re-targeted beams and a fairly densely placed active subscriber positions, option 1 is preferable for both types of antennas.

It was noted above that phase shifters cannot be used in telecommunication antennas to deflect the beam. This implies the use of true time delays and a rather complicated beamforming system, for example, digital. In the present invention, this system can be much simpler due to the fact that for a receiving antenna it is necessary to analyze signals not from the entire array of partial feeders, as in classical AESA (at least a thousand feeders), but only from a subarray containing 100-200 feeders (variant 1).

Variant 2, in which all feeders are involved for each beam, is preferably used as a transmitting antenna, for which the beam formation task is much simpler than for the receiving one. This task is reduced to the timely, according to the delays that were calculated in advance for each subscriber position, the delivery of an already filtered by receiving antenna signal to each feeder.

In both variants, the reflecting surfaces of the focusing system are designed as surfaces with a continuous second derivative. If the continuity condition of the second derivative is not met, the reflected wave front will immediately intersect itself, and cannot be reproduced by ID feeders.

It should be noted that in the context of the present invention, the concepts of "focal point" and "focal surface" lose their meaning. In this case, the reflecting surface of the focusing system may be a surface of revolution of a conic section, with an axis of revolution which does not coincide with the axis of the conic section itself. Moreover, a reflecting surface can be formed, for example, by drawing one, perhaps variable, curve along another, guiding curve. The only requirement is that the self-intersection region of the non-planar front 5*e* must be outside the radiating surface 3.

This provides greater flexibility in optimizing the scheme of the antenna for different configurations of the service area and layout of the spacecraft.

The implementation of the invention can be performed as follows:

Structurally, the antennas in both variants practically do not differ from the known PAFR schemes. At the same time, wider possibilities for optimizing the geometry of the antennas facilitate their integration into the layout of the spacecraft.

In the process of optimization, ray tracing is performed from arbitrary planes 4 . . . 6 in the directions from the specified subscriber positions and the following are determined:

- geometry of the reflector (reflectors) and the irradiating device;
- amplitude-time parameters for each feeder 2 in each direction (Variant 1—subarrays of feeders 2, Variant 2—all feeders 2).

In the future, these tables of amplitude-time parameters, after some adjustments as a result of testing and operating the antenna, are used by the beamforming system.

The use of an active phased array as an irradiating device with the formation of non-planar wave fronts equidistant to plane wave fronts in given directions will allow to achieve the following advantages:

- simplification of the beamforming system;
- reduction of antenna size due to the "short focus" of reflectors;
- providing a large service area, with minimal loss of gain and beam width;
- providing a large number of active rays;
- providing great flexibility in optimizing the scheme of the antenna.

Thus, all the tasks of this invention are completed.

Although the present disclosure has been described with reference to one or more examples, workers skilled in the art will recognize that changes may be made in form and detail without departing from the scope of the disclosure and/or the appended claims.

The invention claimed is:

1. A multi-beam antenna comprising:

a focusing system, comprising a concave mirror;

an irradiating device designed to irradiate the concave mirror, and comprising a two-dimensional array of feeders, placed at a distance from the concave mirror and overlapping beam projection zones at this distance; and a beamforming system, which serves at least one subarray of feeders of the two-dimensional array of feeders, providing one beam in a given direction, wherein, for each such beam, the beamforming system is configured to provide amplitude-time parameters of a transmitted signal for each feeder in the sub-array, to form a non-planar wave front, which is equidistant through the concave mirror to a flat wave front of such a beam, and wherein a radiating surface of the irradiation device is outside a self-intersection zone of the non-planar wave front.

2. The multi-beam antenna according to claim 1, wherein the focusing system comprises a reflecting surface, which is designed as a surface of revolution of a conical section, and an axis of rotation of the conical section does not coincide with axes of the same conical section.

3. The multi-beam antenna according to claim 1, wherein the focusing system comprises a reflecting surface, which is designed as a pulling surface of a forming curve with a continuous second derivative.

4. The multi-beam antenna according to claim 3, wherein the reflecting surface of the focusing system is designed as a pulling surface of a variable forming curve along a guiding curve.

5. A multi-beam antenna comprising:

a focusing system, comprising primary and secondary concave mirrors;

an irradiating device designed to irradiate the focusing system, and comprising a two-dimensional array of feeders providing a plurality of beams, placed at a distance from the secondary mirror and overlapping an intersection of projections of the beams at this distance; and a beamforming system, which serves all feeders of the two-dimensional array of feeders, providing at least one beam in a given direction, wherein, for each such beam, the beamforming system provides amplitude-time parameters of a transmitted signal for each feeder to form a non-planar wave front, which is equidistant through the focusing system to the flat wave front of such the beam, and wherein a radiating surface of the irradiation device is located outside a self-intersection zone of non-planar wave fronts.

6. The multi-beam antenna according to claim 5, wherein at least one concave mirror is designed as a surface of revolution of a conical section, and an axis of rotation of the conical section does not coincide with axes of the same conical section.

7. The multi-beam antenna according to claim 5, wherein at least one of the primary concave mirror or the secondary concave mirror of the focusing system is designed as a pulling surface of a forming curve with a continuous second derivative.

8. The multi-beam antenna according to claim 7, wherein the reflecting surface of the mirror is designed as a pulling surface of a variable forming curve along a guiding curve.

* * * * *